US006066044A

United States Patent [19]

Orendorff

[11] Patent Number: 6,066,044

[45] Date of Patent: May 23, 2000

[54] VENT ASSEMBLY

[75] Inventor: Gary R. Orendorff, Beaverton, Oreg.

[73] Assignee: Classic Manufacturing, LLC, Portland, Oreg.

[21] Appl. No.: 09/208,292

[22] Filed: Dec. 8, 1998

[51] Int. Cl.[7] ..... F24F 7/00

[52] U.S. Cl. ..... 454/290; 454/325; 55/493

[58] Field of Search ..... 454/290, 289, 454/311, 309, 325, 322; 55/480, 493, DIG. 31

[56] References Cited

U.S. PATENT DOCUMENTS

| | | | |
|---|---|---|---|
| 1,151,359 | 8/1915 | Hood | 454/290 |
| 3,391,629 | 7/1968 | Snell | 454/290 |
| 4,171,211 | 10/1979 | Carter | 55/493 |
| 4,520,715 | 6/1985 | Coomes et al. | 454/290 |
| 5,716,270 | 2/1998 | Chambers | 454/332 |
| 5,863,310 | 1/1999 | Brown et al. | 55/480 |
| 5,984,776 | 11/1999 | Berger | 454/290 |

*Primary Examiner*—Harold Joyce
*Assistant Examiner*—Derek S. Boles
*Attorney, Agent, or Firm*—Klarquist Sparkman Campbell Leigh & Whinston, LLP

[57] ABSTRACT

A vent assembly includes a vent cover which is detachably mounted to a damper housing. Couplers mounted to the damper housing each have a catch portion which is inserted into a respective air flow slot of the vent cover to engage the vent cover and couple these components together. The couplers may be constructed to permit flexing of the couplers during the insertion process, with the couplers being biased to engage the vent cover when no longer flexed. A filter housing may be detachably coupled to the damper housing to support a filter on the opposite side of the damper housing from the vent cover.

32 Claims, 4 Drawing Sheets

12
34
30
26
32
72
232
102
50
100
240

VENT ASSEMBLY

BACKGROUND

Duct openings in, for example, heating and ventilation systems, are typically covered by a vent cover for aesthetic and functional reasons. In the case of floor ducts, vent covers are also provided for safety reasons to prevent someone from stepping into an otherwise open duct opening. Vent covers typically have a plurality of air flow slots or openings through a central region of the vent cover through which air passes.

A damper is often provided in the duct opening. In some cases, both the vent cover and damper have been made out of metal and are welded together as a unit and mounted in place by positioning the damper in the duct opening. The vent cover, which typically has cross-sectional dimensions greater than those of the duct opening, engages the floor adjacent to the duct opening and prevents the vent cover and damper combination from dropping into the duct opening.

It is also known to make vent covers of wood with a plurality of air flow slots being provided through the wooden vent cover. The slots are defined typically by vanes included in the vent cover. In one common construction, the vanes defining the slots at opposite ends of the vent cover have an upper surface which is angled to extend downwardly and away from the outer ends of the vent cover. Vent covers of this type have been known to be mounted by screws or glue to a damper to form a vent cover damper combination which is then positioned in the duct opening with the vent cover spanning the duct opening and preventing the combination from slipping into the duct.

When screws are utilized to mount the wooden vent cover to the damper, the vent cover can split as the screws are tightened. This adds to the cost as replacement of the vent cover is often required under these circumstances. In addition, if a vent cover is permanently attached to a damper housing, as by glue, it makes it difficult to clean the interior of the damper housing.

A conventional damper includes a rectangular housing with first and second end walls, side walls, and louvers positioned in the bottom of the damper housing. The louvers are mechanically linked to a lever which is accessible through one of the air flow slots to adjust the damper louvers and thereby control the flow of air through the damper housing and vent cover.

SUMMARY

In accordance with one aspect, a vent assembly is described with a vent cover, a damper with a housing, and with first and second vent cover couplers detachably coupling the vent cover to the damper. In one approach, the vent cover couplers slidably engage the vent cover. In one specific form of assembly, (a) screws and other mechanical fasteners of this type are not required; and (b) tools are not required to attach and detach the vent cover from the damper. In a conventional manner, the damper housing may have first and second ends and side walls. In addition, the vent cover may have a plurality of air passageway slots with a first of the slots being positioned adjacent to a first end of the damper housing and a second of the slots being positioned adjacent to a second end of the damper housing when the vent cover is in a first or installed position overlying the damper. In an illustrated example, the first vent cover coupler extends from the damper housing into the first or associated slot when the vent cover is in the first position. In addition, in this example, the second vent cover coupler similarly extends from the damper housing into the second or associated slot when the vent cover is in the first position.

One of the first or second vent cover couplers, and typically each of the vent cover couplers, may comprise a resilient element which is flexed in a first direction to permit insertion of catch portions of the first and second vent cover couplers into the associated first and second slots. The resilient element moves in the second direction opposite the first direction to cause the catch portion to engage the associated slot when no longer flexed. In this case, the catch portion slides into engagement with the associated slot.

The vent cover couplers may each include a body portion mounted to the damper housing and a catch portion supported by the body portion and extending into the associated one of the first and second slots when the vent cover is coupled to the damper housing. In one specific form, the body of each of the first and second vent cover couplers has a wall portion positioned at the exterior of the damper housing and a vent engagement flange portion which extends from the wall portion. In this specific construction, the wall portion of the first coupler is positioned adjacent to the first end of the damper housing and the wall portion of the second coupler is positioned adjacent to the second end of the damper housing. Each of the flange portions may have a first section extending inwardly to position an inner portion of the first section within the interior of the damper housing. In addition, each flange portion may also have a second section extending outwardly toward the exterior of the damper housing from the inner portion of the first section and also extending upwardly toward the vent cover. The second section is configured to engage the associated one of the first and second vent cover slots when the vent cover is in the first position overlying the damper. More specifically, the vent cover may include air slot bounding surfaces which extend downwardly and inwardly along the outermost boundaries of the respective first and second slots for engagement by the respective second sections of the couplers to detachably couple the damper to the vent cover.

In a specific form, each of the first and second sections of the respective couplers may be planar with an acute angle provided between the first and second sections. As a specific example, the acute angle may be about sixty degrees.

The vent cover couplers may also have a base with first and second side flanges adapted to engage and mount the couplers to the respective sides of the damper housing.

One or more spacers, for example a plurality of spaced apart spacers, may be used to space the wall portion of each coupler away from the adjacent end of the damper housing. These spacers may comprise projections formed in the body of the coupler and projecting from the body toward the adjacent end of the housing.

A filter assembly may be detachably mounted to the damper so as to position the filter at the opposite side of the damper from the vent cover when the vent cover, damper, and filter are positioned in a duct opening. If included, the filter assembly may include a filter housing with a filter positioned therein and may also include first and second filter couplers for detachably coupling the filter housing to the damper housing. In this regard, the filter couplers may detachably and slidably engage the respective first and second vent cover couplers to detachably mount the filter housing in place. The vent cover couplers may have filter hangers which are detachably engaged by the respective filter couplers to mount the filter housing in place.

The filter couplers may include the same elements as each of the vent cover couplers, namely, a body, a wall portion, and a flange portion with first and second sections. In this case, the filter hanging projections may be engaged by the second sections of the filter couplers to detachably hold the filter housing and thereby the filter in place.

The illustrated form of couplers are unique and are used for interconnecting components of a vent assembly such as a damper to a vent cover and/or a filter assembly to a damper. In one approach, the couplers are of unitary one-piece construction and are formed from a single planar sheet of metal.

A housing assembly, such as a damper housing or filter housing, is selectively detachable from another component of a vent assembly (e.g. a vent cover or damper). The housing assembly includes a housing body having an interior and exterior, and also having first and second end wall portions. The housing assembly may include at least one coupler having a wall positioned adjacent to a first end portion of the housing body and a catch portion supported by the wall. The wall in this case may be movable in a first direction relative to the housing body so as to move the catch portion in one direction. The wall also may be movable in this case in a second direction opposite the first direction and relative to the housing so as to move the catch portion in another direction opposite to said one direction. In this case, the catch portion is operable such that, as the catch portion moves in said one direction, the catch portion disengages the vent assembly component and, as the catch portion moves in the second direction, the catch portion engages the vent assembly component. In this manner, the housing assembly is selectively detachable from the component of the vent assembly when the catch portion is moved in said one direction. A similar coupler may be positioned adjacent to the second end portion of the housing body, although a different type of coupling mechanism may be used at such location. The coupler may include a base portion coupled to the first end portion of the housing body and supporting the wall with the base portion positioned exteriorly of the housing body. The catch portion may include a latch, such as a flange, configured to selectively and slidably disengage and engage the component of the vent assembly as the catch portion moves in the respective one and another directions. The base may also include first and second legs for coupling to respective first and second side wall portions of the housing body.

A unique method of detachably coupling a damper housing to a vent cover is also described.

The present invention relates to unique and non-obvious features and steps set forth in this disclosure individually as well as to unique and non-obvious combinations thereof.

BRIEF DESCRIPTION OF THE DRAWINGS

FIG. 4 is a perspective view of one form of coupler for interconnecting components of the vent assembly of FIG. 1.

DESCRIPTION OF AN ILLUSTRATED EMBODIMENT

Figure 1:
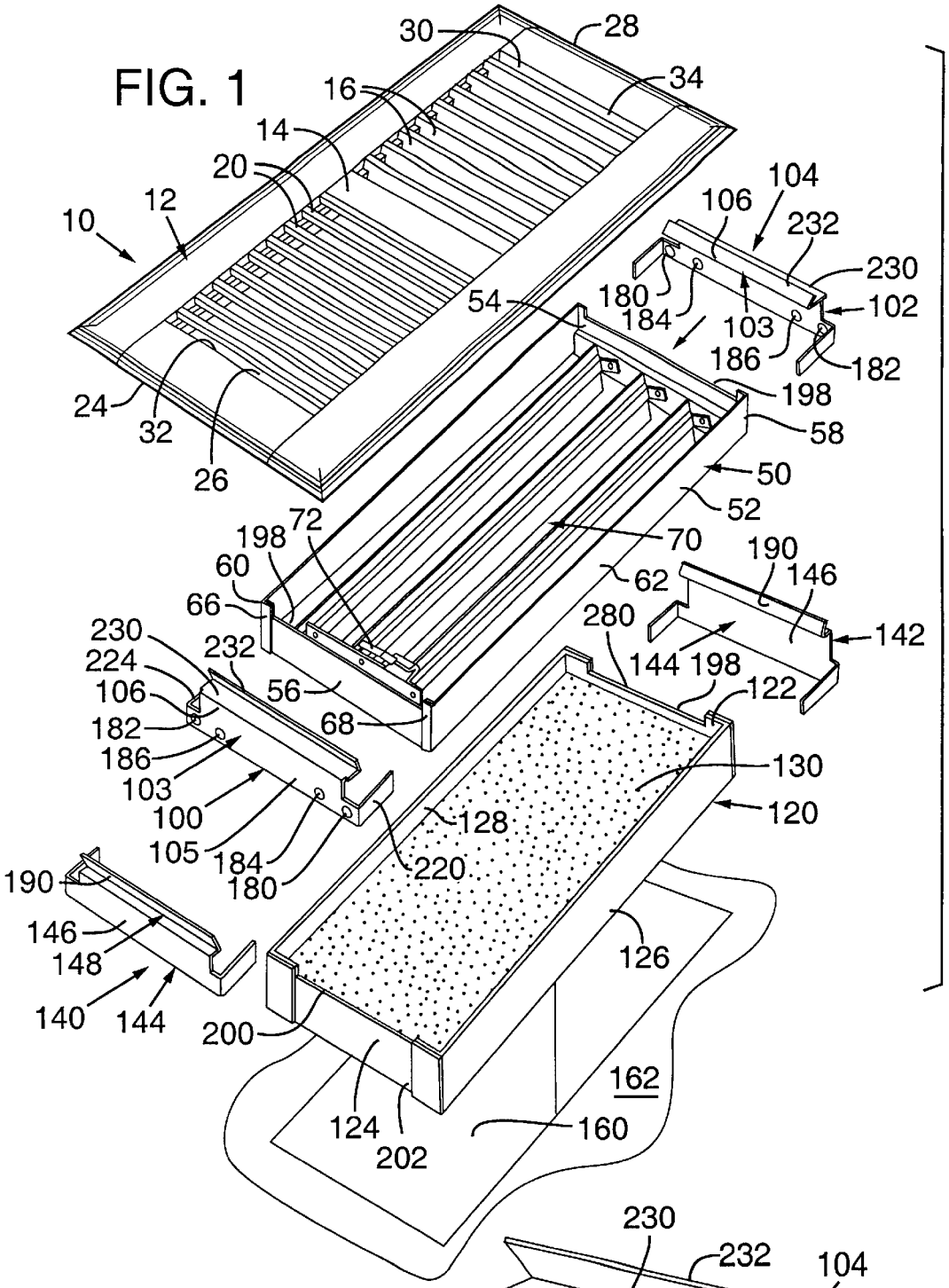
FIG. 1 is an exploded view of one form of a vent cover assembly for installation into a duct opening.

With reference to FIG. 1, one form of vent assembly 10 is shown. The illustrated vent assembly includes a vent cover 12 having an elongated central region 14 through which a plurality of air flow slots, some being indicated at 16, are provided to permit the passage of air through the vent cover. The slots 16 extend transversely relative to the longitudinal axis of the vent cover and are defined by respective air flow deflector vanes, some of which are indicated at 20 in FIG. 1. A first of the slots 16 adjacent to one end portion 24 of the vent cover 12 has been assigned the number 26 in FIG. 1. In addition, a second of the slots 16 adjacent to the opposite end 28 of the vent cover from end 24 has been assigned the number 30. The slot 26 is bounded at one side, its outer side, by a downwardly and inwardly inclined vane surface 32 while the slot 30 is bounded at one side, its outer side, by a downwardly and inwardly inclined surface 34. The illustrated vent cover 12 is preferably of wood, although it may be of any other suitable material such as of metal or plastic. Wooden vent covers of the type illustrated in FIG. 1 are commercially available, such as from Classic Manufacturing NW, LLC., of Portland, Oreg.

The vent assembly 10 also includes a damper 50 which, in the illustrated form, comprises a rectangular, elongated, box-like housing 52 having an interior 54 and an exterior which is outside of the damper housing. The illustrated damper 50 has first and second parallel, spaced-apart, opposed end walls 56, 58. In addition, the damper housing 52 has first and second parallel, spaced apart side walls 60, 62. During manufacture, the illustrated damper 50 has its side walls 60, 62 folded at respective end portions 66, 68 to overlap the end wall 56. The opposite end of the damper housing 52 is similarly constructed. Louvers 70, mechanically linked to a lever 72, are controlled by the lever to adjust the flow of air through the damper 50. When the damper 50 is joined to the vent cover 12, the lever 72 is accessible through one of the slots 16, such as slot 26, so that it may be shifted to open and close the louvers 70. To this point, the description of damper 50 is of a commercially available damper such as from Shoemaker, of Cle Elum, Wash.

Other styles of vent covers and dampers may also be used.

The damper 50 is detachably coupled to the vent cover 12. In accordance with one specific approach, couplers are provided for selectively engaging and disengaging the vent cover to thereby couple the damper housing to the vent cover. More specifically, the couplers may detachably engage the air slots of the vent cover to join the components.

In one specific form, first and second couplers 100, 102 are provided. Although these couplers may be of a different construction from one another, in the illustrated form they are identical. The illustrated coupler 102 includes a body 103. One form of a catch portion 104 is supported by the body and, more specifically, is positioned at the upper end portion of a wall 106 of the body. As will be described in greater detail below, when coupler 102 is mounted to the damper housing, with wall 106 adjacent to end wall 58 of the damper housing, the catch portion 104 is positioned to engage the vent cover and, more specifically, the surface 34 bounding air flow slot 30. When mounted in place, wall 106 is spaced from wall 58. As a result, wall 106 may be deflected or flexed toward wall 58. This results in catch portion 104 moving in a direction generally toward the damper wall 56 opposite to wall 58. As catch portion 104 moves in this direction, it clears the surface 34, permitting removal of the catch portion downwardly through the slot 30 to decouple the vent cover from the damper housing. After catch portion 104 of coupler 102 is clear of the vent cover 12, the damper housing 50 is typically pivoted about catch portion 104 of coupler 100 through a small arc, freeing the catch portion 104 of the coupler 100 from engagement with the slot 26.

The vent assembly of FIG. 1 may also include an optional filter assembly. The filler assembly may include a filter housing having first and second end walls 122, 124 and side walls 126, 128, which together form a box-like filter housing construction. A filter 130, which may be of a suitable commercially available material, with a polyester or fiberglass pad from Air Filters, Inc., of Houston, Tex., being an example, is supported within housing 120. The illustrated filter housing 120 is most preferably detachably coupled to the damper housing 50 at the opposite side of the damper housing from the vent cover 12. Couplers such as indicated at 140, 142, which may be like couplers 100, 102, are mounted to filter housing 120 and used to detachably couple the filter housing to the damper. Except where differences are pointed out below, the couplers 140, 142 may be identical to the couplers 100, 102. Consequently, the description of coupler 100 set forth below applies equally to the couplers 140, 142.

Thus, each of the couplers 140, 142 illustrated in this figure includes a body 144, a wall 146, and a catch portion 148. The wall 146 may be spaced from end wall 124 to permit flexing and movement of the catch portion 148 to disengage the catch portion and thereby the filter housing from the damper housing. The filter may be detachably coupled to damper housing 50 in other ways. For example, mechanical fasteners, although less preferred, could be used. In addition, hangers may be used to suspend the filter housing from pegs or other projections or slots or engagement mechanisms included in the damper housing. It should be noted that the filter housing and filter assembly may be used in applications where air filtration is desired at the vent outlet 160.

When the assembly is interconnected, the vent cover, damper housing and filter combination may be inserted in a duct opening such as indicated at 160 at FIG. 1. Duct opening 160 is shown as a floor duct opening bounded by a floor 162. The longitudinal and transverse cross-sectional dimensions of vent cover 12 are greater than the longitudinal cross-sectional dimensions of the duct opening 160 so that the assembly does not fall into the duct opening when installed. It is also possible for the assembly to be sized differently. For example, supports may be included in the duct opening to hold the assembly in place in the event the vent cover is made to have cross-sectional dimensions which are smaller than those of the duct opening for recessing into the duct opening.

Figure 2:
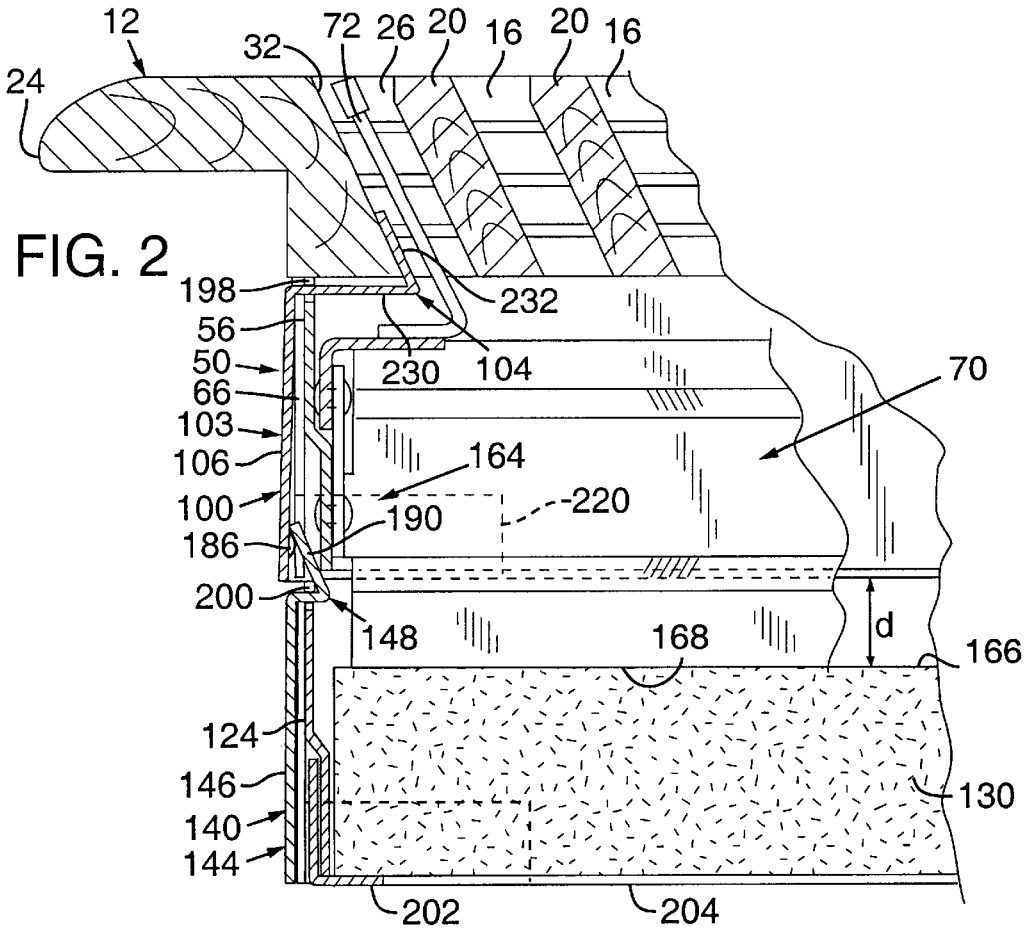
FIG. 2 is a partially broken away longitudinal and vertical sectional view of an end portion of the vent assembly of FIG. 1 with the components thereof assembled together.
Figure 3:
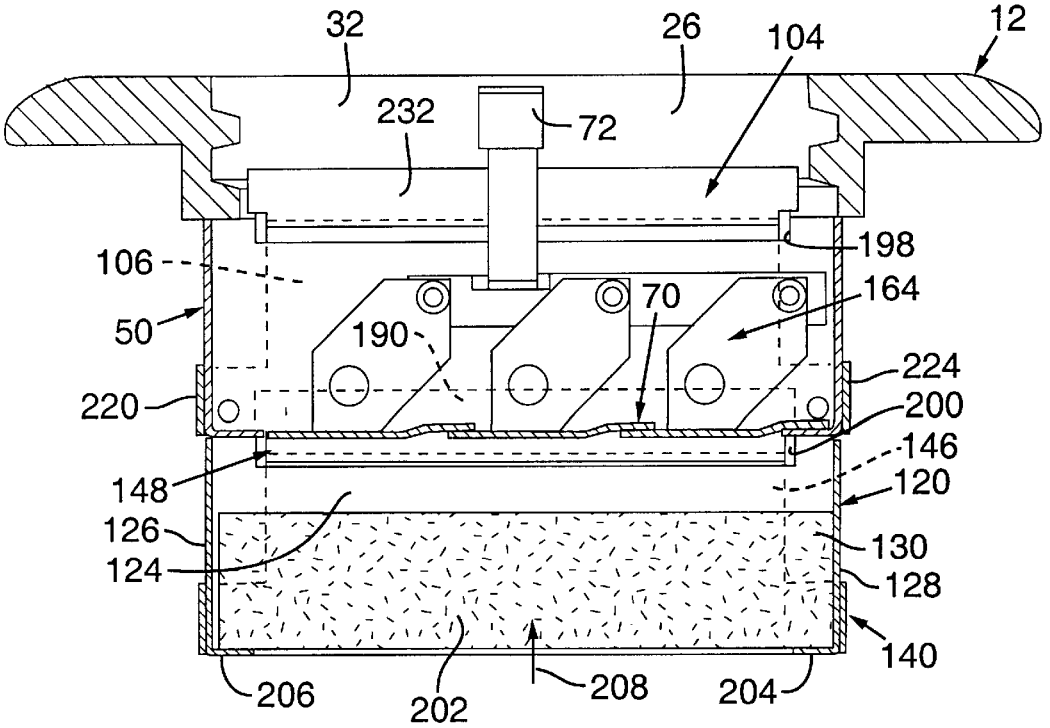
FIG. 3 is a transverse cross-sectional view of an assembled vent assembly in accordance with FIG. 1.

FIGS. 2 and 3 illustrate the combined components utilized in the vent assembly of FIG. 1. These figures also illustrate a conventional linkage 164 operated by lever 72 to open and close the louvers 70 of the damper 50. In FIG. 2, the louvers are shown in their open position. When open, adequate clearance "d" is provided between the upper surface 166 of the filter 130 and the lower edges, one being indicated at 168 in FIG. 2, of the louvers 70.

Figure 8:
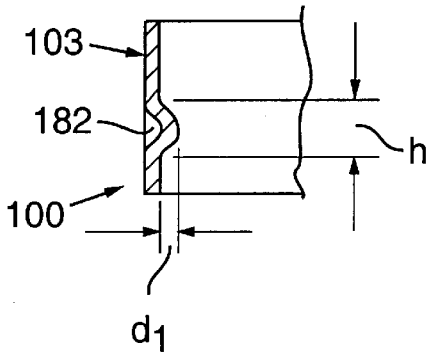
FIG. 8 is a partially broken away sectional view of a portion of the coupler of FIG. 4, illustrating a base portion of the coupler with a projection formed therein.

In the illustrated construction, spacing is maintained between the upright wall of each coupler and the adjacent end wall of the associated housing to facilitate flexing of the upright wall and movement of the associated catch portion. One or more spacers may be used for this purpose. In FIG. 1, the coupler 100 is shown with first and second spaced-apart spacers 180, 182 which are formed in the body 103 of the coupler. FIG. 8 illustrates one form of projection 182 in greater detail, which may be formed, for example, by punching the base of the body 103. Although variable, the illustrated projection 180 has a height "h" of 0.12 inch, and a depth "$d_I$" of 0.03 inch. In this specific example, the coupler 100 is made from a single sheet of 22 gauge (0.03 inch) cold rolled low carbon steel and thus the illustrated coupler is of a monolithic, uniform, one-piece construction. When coupler 100 is mounted to damper housing 50, the projections 180, 182 bear against the respective end flaps 66, 68 and assist in spacing the wall 106 from the end wall 56. Again, coupler 102 may be similarly constructed.

Additional projections 184, 186 may be formed in the same manner in the body 103 for use as a specific form of filter hanger. Since nothing is suspended from the filter housing in the FIG. 1 construction, hanging mechanisms such as the projections 184, 186, may be eliminated from the filter couplers. As can be seen in FIG. 2, the catch portion 148 of filter coupler 140 has an upper section 190 which detachably engages the projection 186 (and also the projection 184, although not shown in FIG. 2). In the same manner, the filter coupler 142 at the opposite end of the filter housing engages projections 184, 186 of the vent cover coupler 102 to thereby suspend the filter housing from the damper housing. By simply depressing or moving the wall portions 146 of the respective filter couplers 140, 142 toward one another, the catch portions 148 of the filter couplers are disengaged from the projections 184, 186 to permit removal of the filter housing. This makes changing of the filter easy to accomplish.

As also can be seen in FIGS. 1 and 2, the respective walls 106, 146 of the couplers 100, 102, 140 and 142 are narrower than the width of the coupler. This increases their flexibility and also positions these walls so as to clear the end flaps 66, 68 as the walls are moved toward the adjacent housing during attachment and detachment of the housing from the adjoining vent component. In addition, as best seen in FIG. 1 at end wall 56, a notch 198 may be provided in the central portion of the end walls. This notch accommodates the catch portion 104 where it extends inwardly into the interior of the housing. A similar notch 200 may be provided in is the end walls 124, 126 of the filter housing. Again, although FIG. 2 illustrates one end portion of the illustrated vent assembly, the opposite end portion of the vent assembly may be the same. The respective walls 122, 124, 126 and 128 of the filter housing 120 typically each have a filter supporting lip along their lower edge, three of which are indicated at 202, 204 and 206 in FIGS. 2 and 3, upon which the filter 130 rests. An opening between the lips, such as indicated by arrow 208 in FIG. 3, allows the free flow of air through the filter. The filter 130, of course, may be supported in any suitable manner.

Figure 5:
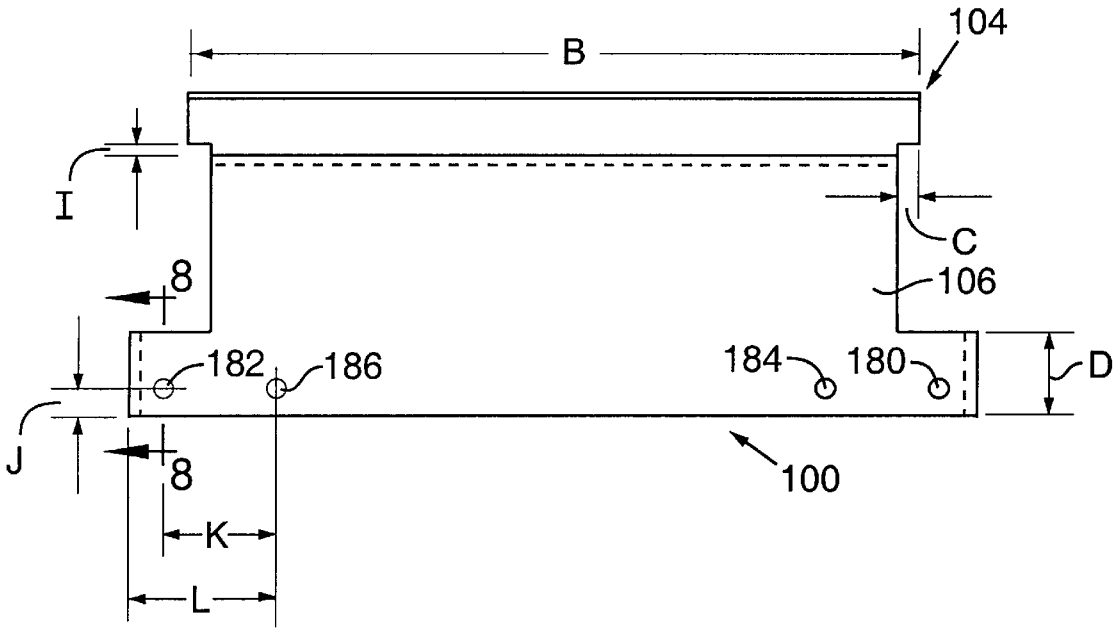
FIG. 5 is an end view of the coupler of FIG. 4.
Figure 6:
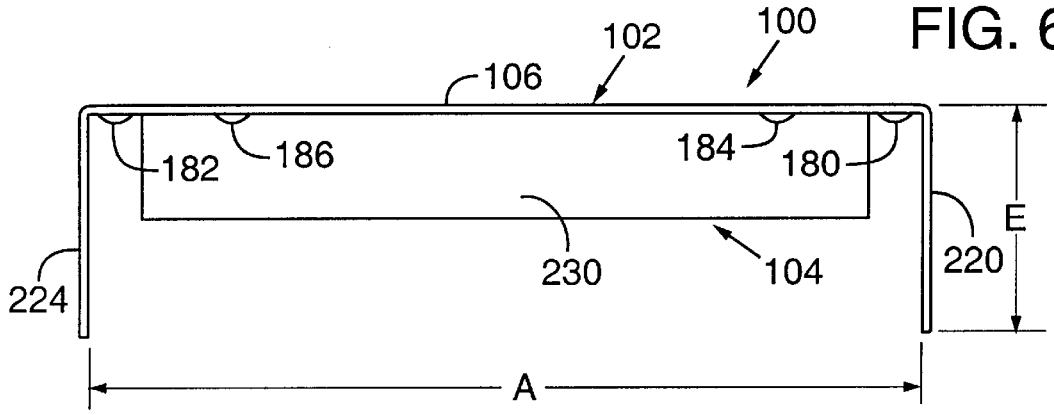
FIG. 6 is a view of the coupler of FIG. 4 looking from the bottom.

The illustrated form of couplers will next be described in greater detail with reference to coupler 100 shown in FIGS. 4 through 8. As best seen in FIGS. 4 and 6, the body 103 includes a base portion 105 which is positioned along the lower portion of the wall 106, with the wall and base portion each being planar. The base portion 105 has side edges that extend outwardly beyond the side edges of the wall 106. The side edges of the base portion are coupled to respective legs 220, 224 which, in the illustrated example, extend at right angles relative to the base portion. When mounted to the damper housing 50, the leg 220 abuts side wall 62 of damper housing 50 (FIG. 1) while the leg 224 abuts side wall 60 of the damper housing. Typically, the legs 220, 224 are spot welded or otherwise secured to the damper housing. In a similar manner, legs of the filter couplers may be mounted to side walls of the filter housing 120.

The illustrated catch portion 104 includes first and second sections 230, 232 which may comprise planar flanges. Section 230 extends inwardly from the upper edge of wall 106 and overlies the interior of the damper housing. More specifically, section 230 may extend at a right angle from the wall 106. In the case of a vent assembly mounted to a horizontal floor, the section 230 would, in this example, be horizontal. The section 230 terminates at an inner portion 234 indicated in FIG. 7. The section 232 projects upwardly from inner portion 234 and at least in part overlies the section 230 (in the case of a horizontally installed vent assembly). An angle $\alpha$ is provided between sections 230 and 232. The angle $\alpha$ is an acute angle and matches the slope on surface 32 relative to horizontal (FIG. 1) of the vane engaged by the catch portion 104. That is, when engaged (as shown in FIG. 2), the section 232 bears against the surface 32. In the illustrated form of coupler, $\alpha$ is about sixty degrees, with sixty-two degrees being a specific example.

Figure 7:
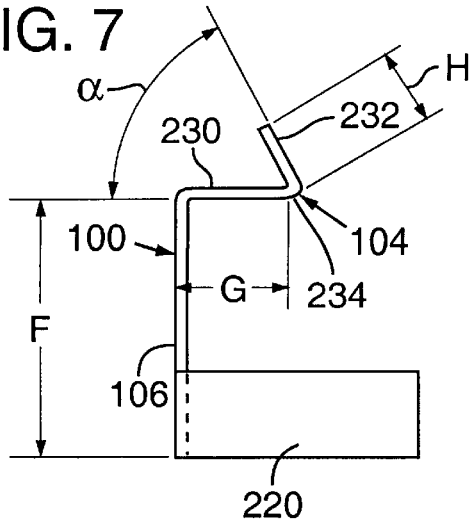
FIG. 7 is a side elevation view of the coupler of FIG. 4.

Although the dimensions of the illustrated form of couplers may be varied, as one specific example of a typical damper with a nominal width of six inches, the following are suitable dimensions. In this example, the letters identify the location of the specific dimension as are depicted in FIGS. 5, 6 and 7.

A. 5.69 inches
B. 5.15 inches
C. 0.10 inch
D. 0.38 inch
K. 0.50 inch
E. 1.0 inch
F. 1.14 inch
G. 0.45 inch (for an illustrated damper housing coupler) and 0.14 inch (for a filter housing coupler)
H. 0.31 inch
I. 0.06 inch
J. 0.14 inch
K. 0.50 inch
L. 0.65 inch Again, the above dimensions are for one specific example of a coupler. These dimensions may be varied and the configuration of the couplers and components thereof, such as the body and catch portions, may also be varied while still selectively engaging the adjacent vent assembly component The method of assembling a vent cover and damper housing utilizing the couplers of the form illustrated in FIG. 1 will be readily apparent from FIGS. 9A, 9B, and 9C.

Figures 9A, 9B, 9C:
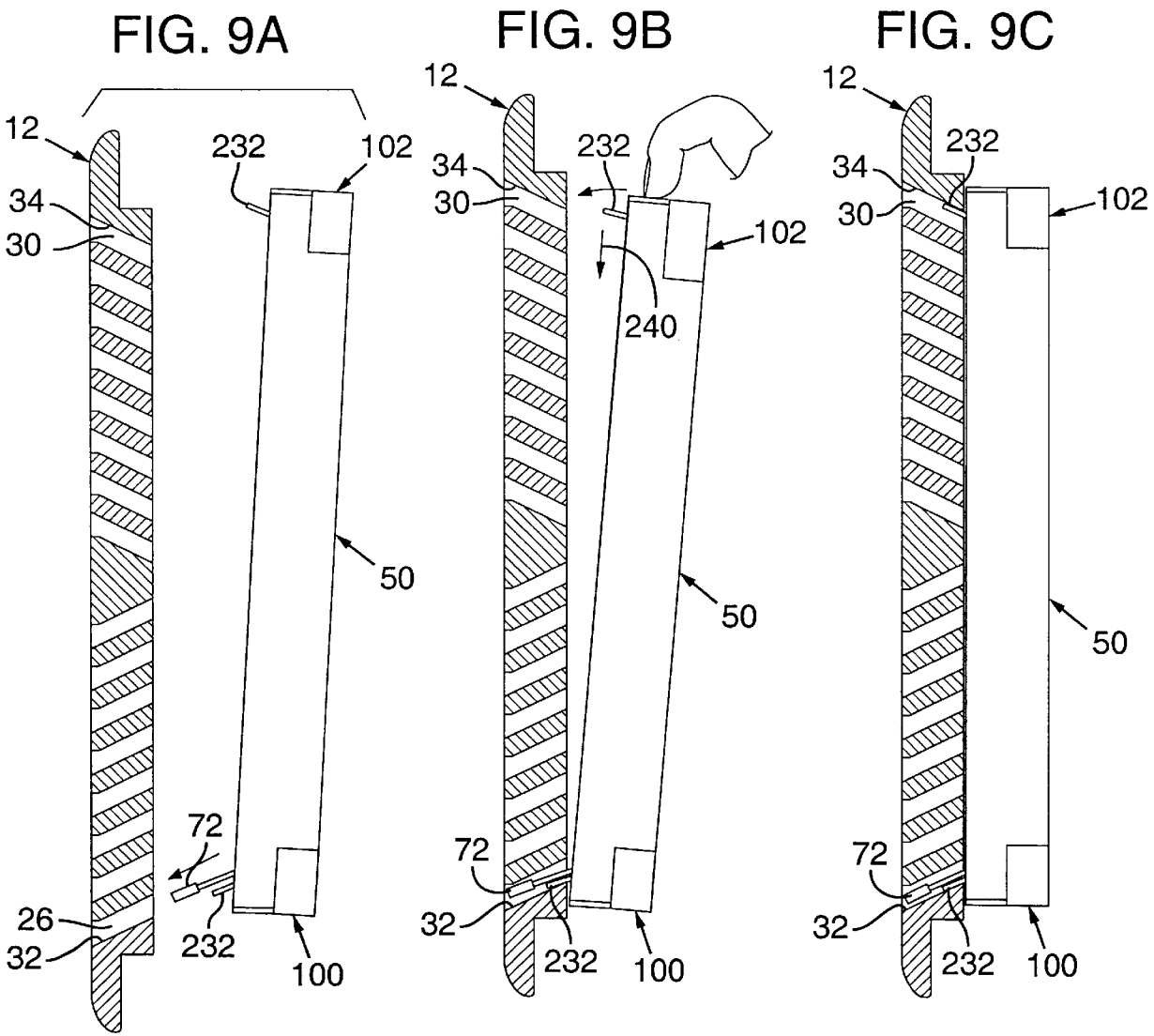
FIGS. 9A, 9B and 9C schematically illustrate a method of detachably interconnecting a damper of a vent cover assembly to a vent cover of the assembly.

With reference to FIG. 9A, the louver control lever 72 is inserted into the slot 26. At the same time, coupler section 232 of the coupler 100 is also positioned within this slot. The vent cover 12 and damper housing 50 are pivoted away from one another slightly to facilitate the positioning of flange 232 of coupler 100 and the louver control 72 into the slot 26. FIG. 9B illustrates the state of the vent assembly when this first step has been accomplished. At this time, the wall of coupler 102 is flexed to shift coupler section 232 of coupler 102 in the direction indicated by arrow 240. This permits the section 232 of coupler 102 to be inserted into the slot 30 by pivoting the vent cover 12 into the position shown in FIG. 9C with the vent cover overlying and abutting the damper housing 50. When pressure is released on coupler 102, the flange 232 of this coupler travels in a direction opposite to the direction 240 and into engagement with the surface 34 bounding the slot 30. In this manner, the vent cover 12 is coupled to the damper housing 50. These steps are may be reversed to detach the damper housing from the vent cover. As an advantage to this specific approach, no tools are needed to install or remove the vent cover from the damper housing. With this approach, the vent engaging portion of coupler 102 may be rigid (e.g. flange 232 being immovable) with all of the flexing being accomplished by the coupler 102.

The illustrated couplers are economical to produce and install. Conventional dampers may be used, although in the preferred approach the conventional dampers are modified to provide a notch (e.g. 198 in FIG. 1) in the end wall of the damper to accommodate the catch portion of the illustrated coupler.

Having illustrated and described the principles of my invention with respect to an illustrated embodiment, it should be apparent to those of ordinary skill in the art that my invention may be modified in arrangement and detail without departing from these principles. For example, although advantages exist for the illustrated form of coupler, the coupler may be configured to detachably engage vent cover other than at the air flow slots. In addition, although the biased flexed element coupling approach described above is advantageous, other forms of detachable couplers may be used which, for example, selectively and slidably interconnect these components. I claim all such modifications and arrangements which fall within the scope of the following claims:

I claim:

1. A vent assembly for a duct opening comprising:

a damper having a housing with first and second ends;

a vent cover having a plurality of air passageway slots through which air passes through the vent cover, a first of such slots being positioned adjacent to the first end of the damper housing and a second of such slots being positioned adjacent to the second end of the damper housing when the vent cover is in a first position overlying the damper;

a first vent cover coupler extending from the damper housing into the first slot when the vent cover is in the first position, with the first vent cover thereby being associated with the first slot, a second vent cover coupler extending from the damper housing into the second slot when the vent cover is in the first position, with the second vent cover coupler thereby being associated with the second slot, the first and second vent cover couplers thereby coupling the damper housing to the vent cover when the vent cover is in the first position, at least one of the first and second vent cover couplers comprising a resilient element which is flexed in a first direction to permit insertion of the first and second vent cover couplers into the associated first and second slots, the resilient element moving in a second direction opposite to the first direction and into engagement with the associated slot when no longer flexed.

2. A vent assembly according to claim 1 including a filter detachably mounted to the damper so as to position the filter at the opposite side of the damper from the vent cover when the vent cover, damper and filter are positioned in the duct opening.

3. A vent assembly according to claim 1 wherein the first and second vent cover couplers each include a body portion mounted to the damper housing and a vent engagement flange portion projecting from the body portion and into the associated one of the first and second slots.

4. A vent assembly according to claim 3 wherein the damper housing has an interior and an exterior, the body of each of the first and second vent cover couplers having a wall portion positioned at the exterior of the damper housing and wherein the flange portion projects from the wall portion, the wall portion of the first coupler being positioned adjacent to the first end of the damper housing, the wall portion of the second coupler being positioned adjacent to the second end of the damper housing, each flange portion having a first section extending inwardly to position an inner portion of the first section within the interior of the damper housing, each flange portion also having a second section extending outwardly toward the exterior of the damper housing from the inner portion of the first section and also extending toward the vent cover such that the second section engages the associated one of the first and second vent cover slots when the vent cover is in the first position.

5. A vent assembly according to claim 4 in which each of the first and second sections are planar and an acute angle exists between the first and second sections of each of the first and second couplers.

6. A vent assembly according to claim 5 in which the acute angle is about sixty degrees.

7. A vent assembly according to claim 4 in which each of the first and second vent cover couplers includes at least one spacer positioned to space the wall portion of the coupler away from the adjacent end of the housing.

8. A vent assembly according to claim 7 in which the at least one spacer comprises a plurality of spaced-apart projections formed in the body and projecting from the body toward the adjacent end of the housing.

9. A vent assembly according to claim 6 including a filter housing and a filter contained within the filter housing, the vent assembly including first and second filter couplers mounted to the filter housing with each filter coupler detachably engaging a respective one of the first and second vent cover couplers to detachably mount the filter housing to the damper housing with the filter at the opposite side of the damper from the vent cover.

10. A vent assembly according to claim 9 in which each of the vent cover couplers has projecting filter hangers and wherein each filter coupler is adapted to detachably engage respective filter hangers to detachably mount the filter housing to the damper housing.

11. A vent assembly according to claim 9 in which each of the filter couplers includes the same elements as each of the vent cover couplers of claim 9, namely, a body, a wall portion and a flange portion with first and second sections.

12. A vent assembly according to claim 6 in which the damper housing has first and second sides, the body of each of the first and second couplers each having a base positioned adjacent to a respective end of the damper housing and first and second side flanges adapted to engage and mount to the respective sides of the damper housing.

13. A coupler for interconnecting components of a vent assembly comprising:

a body having a base portion for mounting to a vent assembly component, the body also having a support portion projecting in a first direction from the base portion and a component engaging portion supported by the support portion, the component engaging portion having a first section projecting in a second direction from the upper end portion of the support portion and terminating at an end portion spaced from the support portion, the second direction being skewed from the first direction, the component engaging portion also having a second section which overlaps the first section at least in part and which extends from the end portion of the first section, the first and second sections being at an acute angle relative to one another, and the body having first and second side legs projecting from the base and adapted for mounting to the vent assembly component.

14. A coupler according to claim 13 which is of unitary one-piece construction and which is formed from a single planar sheet of metal.

15. A coupler according to claim 14 including a plurality of spaced-apart projections extending generally in the second direction from the base.

16. A housing assembly which is selectively detachable from a component of a vent assembly, the housing assembly comprising:

a housing body having an interior and an exterior and first and second upright end portions;

a coupler having an upright wall positioned adjacent to the first end portion of the housing body, the coupler also including a catch portion supported by the upright wall, the upright wall being movable in a first direction relative to the housing body so as to move the catch portion in one direction and being movable in a second direction opposite to the first direction and relative to the housing so as to move the catch portion in another direction opposite to said one direction, the catch portion being operable such that as the catch portion moves in said one direction the catch portion disengages the vent assembly component and as the catch portion moves the second direction the catch portion engages the vent assembly component, whereby the housing assembly is selectively detachable from the component of the vent assembly when the catch portion is moved in said one direction.

17. A housing assembly according to claim 16 in which the housing body comprises a vent damper housing and the component of the vent assembly is a vent cover.

18. A housing assembly according to claim 16 in which the housing body comprises a filter housing and the component of a vent assembly is a damper housing.

19. A housing assembly according to claim 16 in which the coupler has a base portion coupled to the first end portion of the housing body and supporting the upright wall, the base portion being positioned exteriorly of the housing body, and wherein the catch portion includes a latching flange configured to selectively disengage and engage the component of the vent assembly as the catch portion moves in the respective one and another directions.

20. A housing assembly according to claim 19 in which the housing body has first and second side wall portions and wherein the base includes first and second legs coupled to the first and second side wall portions.

21. A housing assembly according to claim 20 in which the base, including the first and second legs, the upright wall and catch portion are of unitary one-piece construction and are formed from a single piece of sheet material.

22. A housing assembly according to claim 16 in which the coupler positioned adjacent to the first end portion of the housing body comprises a first coupler, the housing assembly including a second coupler like the first coupler and positioned adjacent to the second portion of the housing body.

23. A vent assembly for a duct opening comprising:

a vent cover with at least first and second spaced-apart air flow slots;

a damper housing; and means extending upwardly into the air flow slots for detachably coupling the damper housing to the vent cover.

24. A vent assembly according to claim 23 including a filter housing and means for detachably coupling the filter housing to the damper housing.

25. A vent assembly comprising:

a vent cover having a plurality of spaced apart air flow slots;

a damper housing; and at least one coupler which is coupled to the damper housing and having an upwardly projecting coupling portion which is positioned to extend upwardly into one of the air flow slots and to slidably engage the vent cover to detachably interconnect the damper housing and vent cover into a vent assembly.

26. A method of detachably coupling a damper housing to a vent cover having first and second spaced-apart air flow slots comprising:

providing a damper housing with first and second upwardly extending catches adjacent to opposite end portions of the damper housing and with at least the second of the catches being movable relative to the damper housing;

inserting the first catch into a first air flow slot of a vent cover;

moving the second catch in a direction toward the first catch to decrease the spacing between the first and second catches;

inserting the second catch into a second air flow slot of the vent cover; and moving the second catch away from the first catch to increase the spacing between the first and second catches such that the first and second catches engage the vent cover to thereby detachably secure the vent cover to the damper housing.

27. A method according to claim 26 including the step of biasing the second catch away from the first catch and wherein the step of moving the second catch in a direction to decrease the spacing between the first and second catches comprises moving the second catch against biasing force, and wherein the step of moving the second catch away from the first catch to increase the spacing between the first and second catches comprises the step of moving the second catch with the applied biasing force.

28. A method according to claim 26 including the step of pivoting the vent cover and damper housing toward one another about the first catch following the insertion of the first catch into the first slot and so as to insert the second catch into the second slot.

29. A method according to claim 26 including the step of moving both first and second catches toward and away from one another to respectively decrease and increase the spacing between the first and second catches.

30. A method according to claim 26 in which the step of moving the second catch comprises the step of flexing a support which carries the second catch to move the second catch.

31. A method according to claim 26 wherein the step of providing first and second upwardly extending catches comprises providing a damper housing with respective first and second couplers fixed to respective end portions of the damper housing, the first catch extending upwardly from the first coupler and the second catch extending upwardly from the second coupler.

32. A vent assembly according to claim 1 wherein the first and second vent couplers are fixedly mounted to respective end portions of the damper housing.

* * * * *

UNITED STATES PATENT AND TRADEMARK OFFICE

CERTIFICATE OF CORRECTION

PATENT NO. : 6,066,044
DATED : May 23, 2000
INVENTOR(S) : Gary R. Orendorff

It is certified that error appears in the above-identified patent and that said Letters Patent is hereby corrected as shown below:

Column 6,
Line 10, change "$d_l$" to -- $d_1$ --.
Line 46, change "in is the" to -- in the --.

Column 7,
Line 35, "K. 0.50 inch"

Signed and Sealed this

Seventh Day of May, 2002

*Attest:*

*Attesting Officer*

JAMES E. ROGAN
*Director of the United States Patent and Trademark Office*